US012339077B2

(12) United States Patent
Nozoe et al.

(10) Patent No.: US 12,339,077 B2
(45) Date of Patent: Jun. 24, 2025

(54) HEAT EXCHANGER TUBE BLOCK, EXHAUST HEAT RECOVERY BOILER, AND METHOD OF CONSTRUCTING EXHAUST HEAT RECOVERY BOILER

(71) Applicant: KAWASAKI JUKOGYO KABUSHIKI KAISHA, Kobe (JP)

(72) Inventors: Takuro Nozoe, Kobe (JP); Yukihiro Takenaka, Kobe (JP); Tatsuo Ino, Kobe (JP); Atsushi Yukioka, Kobe (JP); Shuji Yamamoto, Kobe (JP); Toshinori Tanaka, Kobe (JP); Ryo Nakamura, Kobe (JP); Hao Zhang, Wuhu (CN); Wei Fang, Wuhu (CN)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 739 days.

(21) Appl. No.: 17/298,794

(22) PCT Filed: Jul. 19, 2019

(86) PCT No.: PCT/JP2019/028493
§ 371 (c)(1),
(2) Date: Jun. 1, 2021

(87) PCT Pub. No.: WO2020/110365
PCT Pub. Date: Jun. 4, 2020

(65) Prior Publication Data

US 2022/0034502 A1 Feb. 3, 2022

(30) Foreign Application Priority Data

Nov. 30, 2018 (CN) ..... 201811453202.6

(51) Int. Cl.
*F28G 7/00* (2006.01)
*F22B 31/08* (2006.01)
*F22B 37/24* (2006.01)

(52) U.S. Cl.
CPC ..... *F28G 7/00* (2013.01); *F22B 31/08* (2013.01); *F22B 37/24* (2013.01)

(58) Field of Classification Search
CPC .. F28G 7/00; F22B 31/08; F22B 37/24; F22B 37/48; F22B 37/483; F22B 37/386;
(Continued)

(56) References Cited

U.S. PATENT DOCUMENTS 1,089,918 A * 3/1914 Frenz ..... F24H 1/40 122/176
3,997,000 A * 12/1976 Piela ..... F28G 7/00 165/84

(Continued)

FOREIGN PATENT DOCUMENTS

CN 203907577 U 10/2014
CN 104696937 A 6/2015

(Continued)

OTHER PUBLICATIONS

Partial English Machine Translation: JP-11294994. Accessed Feb. 2024.*

*Primary Examiner* — Tavia Sullens
(74) *Attorney, Agent, or Firm* — Oliff PLC

(57) ABSTRACT

A heat exchanger tube block is stacked on another heat exchanger tube block in an upper-lower direction and connected to the another heat exchanger tube block. The heat exchanger tube block includes: a duct casing wherein exhaust gas containing dust flows in the upper-lower direction; a heat exchanger tube in the duct casing extends horizontally; an inlet header connects to the heat exchanger tube inlet; an outlet header connected to an outlet of the heat (Continued)

exchanger tube; and a vibration transmitting member transmitting vibration, applied to an upper end part of the vibration transmitting member, to the heat exchanger tube to make the dust accumulating on the heat exchanger tube fall. A lower end of the duct casing is formed horizontally. The inlet header is located higher than the lower end of the duct casing. The outlet header is located higher than the lower end of the duct casing.

5 Claims, 2 Drawing Sheets

(58) Field of Classification Search
CPC ..... F22B 37/54; F24H 9/0042; F24H 1/40; F24H 1/41; F24H 1/406; F24H 1/43; F28D 21/0003; F28D 7/08; F28D 7/087; F28D 7/082; F28D 7/085
See application file for complete search history.

(56) References Cited

U.S. PATENT DOCUMENTS

| | | | | |
|---|---|---|---|---|
| 4,203,300 | A | 5/1980 | Hanson et al. | |
| 4,522,157 | A * | 6/1985 | O'Sullivan | F22B 37/24 122/367.1 |
| 2018/0023806 | A1 | 1/2018 | Takenaka et al. | |

FOREIGN PATENT DOCUMENTS

| | | | | |
|---|---|---|---|---|
| CN | 105066435 | A | 11/2015 | |
| CN | 209588012 | U | 11/2019 | |
| DE | 196 30 482 | A1 | 1/1998 | |
| EP | 3086034 | A1 * | 10/2016 | F22B 37/104 |
| JP | 11294994 | A * | 10/1999 | F28G 7/00 |
| JP | 2005-42960 | A | 2/2005 | |
| JP | 2018-36014 | A | 3/2018 | |

* cited by examiner

HEAT EXCHANGER TUBE BLOCK, EXHAUST HEAT RECOVERY BOILER, AND METHOD OF CONSTRUCTING EXHAUST HEAT RECOVERY BOILER

TECHNICAL FIELD

The present invention relates to a heat exchanger tube block constituting part of an exhaust heat recovery boiler, the exhaust heat recovery boiler, and a method of constructing the exhaust heat recovery boiler.

BACKGROUND ART

Known as a method of constructing an exhaust heat recovery boiler is a method of: manufacturing a plurality of blocks constituting the exhaust heat recovery boiler in a factory; conveying the blocks to a construction site; and assembling the blocks at the construction site (see PTL 1 below, for example). When the exhaust heat recovery boiler is constituted by the blocks as above, the amount of work at the construction site decreases, and the exhaust heat recovery boiler can be quickly constructed.

CITATION LIST

Patent Literature

PTL 1: Japanese Laid-Open Patent Application Publication No. 2005-42960

SUMMARY OF INVENTION

Technical Problem

When the exhaust heat recovery boiler is constituted by the blocks, the configuration of each block significantly influences the efficiency of conveying work and the efficiency of assembly work. The configuration of the block regarding a heat exchanger tube having an especially complex structure and its periphery is extremely important. The present invention was made under these circumstances, and an object of the present invention is to provide a heat exchanger tube block by which conveying work and assembly work can be performed efficiently. Another object of the present invention is to provide an exhaust heat recovery boiler which can be constructed efficiently. Yet another object of the present invention is to provide a method of efficiently constructing an exhaust heat recovery boiler.

Solution to Problem

A heat exchanger tube block according to one aspect of the present invention is a heat exchanger tube block stacked on another heat exchanger tube block in an upper-lower direction and connected to the another heat exchanger tube block. The heat exchanger tube block includes: a duct casing in which exhaust gas containing dust flows in the upper-lower direction; a heat exchanger tube located in the duct casing and extending in a horizontal direction; an inlet header connected to an inlet of the heat exchanger tube; an outlet header connected to an outlet of the heat exchanger tube; and a vibration transmitting member configured to transmit vibration, applied to the upper end part of the vibration transmitting member, to the heat exchanger tube to make the dust accumulating on the heat exchanger tube fall. A lower end of the duct casing is formed horizontally. The inlet header is located higher than the lower end of the duct casing. The outlet header is located higher than the lower end of the duct casing.

In the heat exchanger tube block, the inlet header and the outlet header are located higher than the lower end of the duct casing. Therefore, when conveying the heat exchanger tube block, a grounding surface which contacts a floor of a cargo bed is the lower end, formed horizontally, of the duct casing. On this account, according to the above heat exchanger tube block, the heat exchanger tube block can be stably mounted on the cargo bed without using a special jig or the like, and therefore, the conveying work of the heat exchanger tube block can be performed efficiently. Moreover, since the above heat exchanger tube block includes the heat exchanger tube, the inlet header, the outlet header, and the vibration transmitting member, attaching work of these components at a construction site can be omitted, and therefore, the assembly work can be efficiently performed.

In the above heat exchanger tube block, the upper end part of the vibration transmitting member may project to an outside of the duct casing.

In the above heat exchanger tube block, the duct casing may include a lower recess formed such that an outer surface of the duct casing is concave inward, and the lower recess may be located under the vibration transmitting member and be formed so as to open downward and outward in the horizontal direction.

In the above heat exchanger tube block, the lower recess is formed at the duct casing. With this, when the heat exchanger tube blocks are stacked on each other in the upper-lower direction, the vibration transmitting member and the vibration generator are located in the lower recess of the heat exchanger tube block adjacently located at the upper side, and therefore, the vibration transmitting member and the vibration generator can be prevented from interfering with the heat exchanger tube block adjacently located at the upper side.

In the above heat exchanger tube block, the inlet header may be located lower than an upper end of the duct casing, and the outlet header may be located lower than the upper end of the duct casing.

According to this configuration, since both of the inlet header and the outlet header are located lower than the upper end of the duct casing, the height of the heat exchanger tube block can be reduced. Therefore, the conveying work of the heat exchanger tube block can be efficiently performed.

In the above heat exchanger tube block, the duct casing may include a hollow portion located under the heat exchanger tube, and the inlet header may be arranged at a position corresponding to the hollow portion.

Since the above heat exchanger tube block includes the hollow portion, the shapes and sizes of components around the hollow portion can be set relatively freely. Therefore, the lower end of the duct casing can be formed horizontally, and in addition, the inlet header and the outlet header can be located higher than the lower end of the duct casing. Moreover, the maintenance of the heat exchanger tube and the inlet header can be performed by utilizing the hollow portion.

In the above heat exchanger tube block, the duct casing may include a hollow portion located under the heat exchanger tube, and the lower recess may be formed at a position corresponding to the hollow portion.

As above, since the shapes and sizes of components around the hollow portion can be set relatively freely, the lower recess can be easily formed under the vibration transmitting member.

In the above heat exchanger tube block, the duct casing may include an upper recess formed such that an outer surface of the duct casing is concave inward. In addition, the upper recess may be formed so as to open upward and outward in the horizontal direction, and the upper end part of the vibration transmitting member may be located in a region defined by the upper recess.

According to this configuration, the duct casing includes the upper recess, and the upper end part of the vibration transmitting member is located in the region defined by the upper recess. Therefore, according to this configuration, when the heat exchanger tube blocks are stacked on each other in the upper-lower direction, the vibration transmitting member and the vibration generator can be prevented from interfering with the heat exchanger tube block adjacently located at the upper side.

Moreover, an exhaust heat recovery boiler according to another aspect of the present invention includes a plurality of heat exchanger tube blocks each of which is the above heat exchanger tube block. The plurality of heat exchanger tube blocks are stacked on each other in the upper-lower direction and connected to each other.

According to this configuration, the exhaust heat recovery boiler which can be constructed efficiently can be provided.

Furthermore, a method of manufacturing an exhaust heat recovery boiler according to yet another aspect of the present invention includes stacking a plurality of heat exchanger tube blocks, each of which is the above heat exchanger tube block, on each other in the upper-lower direction and connecting the plurality of heat exchanger tube blocks to each other.

According to this configuration, the method of efficiently constructing the exhaust heat recovery boiler can be provided.

Advantageous Effects of Invention

According to the above configuration, the heat exchanger tube block by which the conveying work and the assembly work can be efficiently performed can be provided. Moreover, the exhaust heat recovery boiler which can be constructed efficiently can be provided. Furthermore, the method of efficiently constructing the exhaust heat recovery boiler can be provided.

DESCRIPTION OF EMBODIMENTS

Embodiment 1

Figure 1:
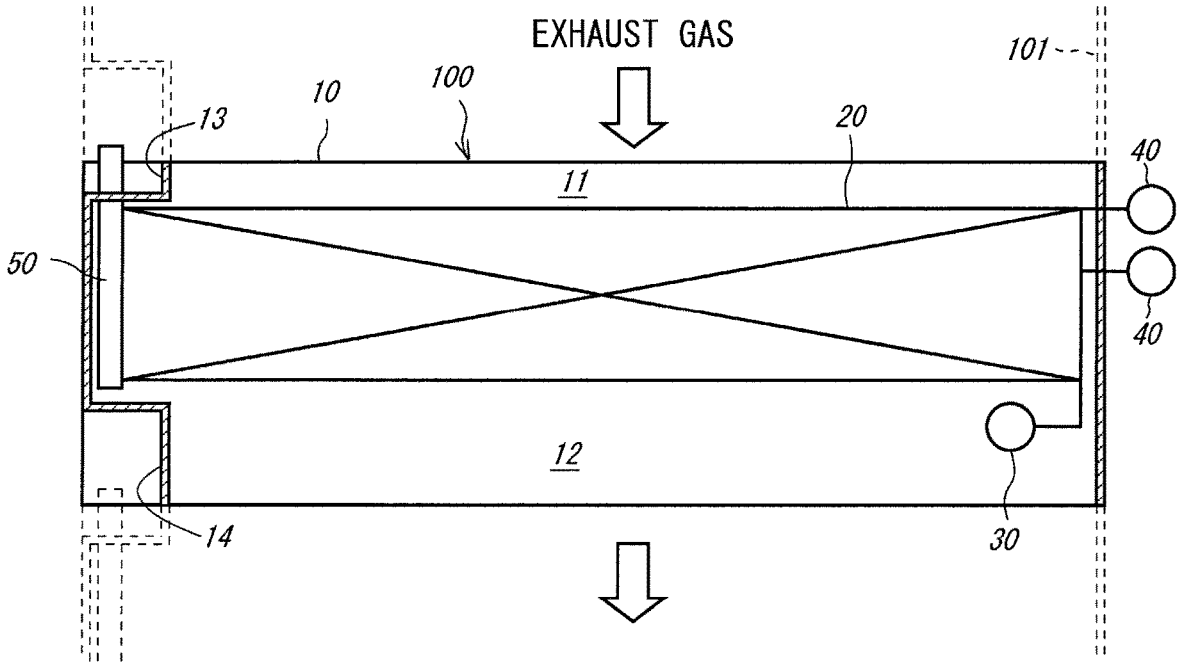
FIG. 1 is a schematic diagram showing a heat exchanger tube block according to Embodiment 1.

First, a heat exchanger tube block 100 according to Embodiment 1 will be described. FIG. 1 is a schematic diagram showing the heat exchanger tube block 100 according to Embodiment 1. The following will be described on the basis that regarding the directions of the heat exchanger tube block 100, upper, lower, near, deep, left, and right sides on the paper surface of FIG. 1 are respectively referred to as upper, lower, front, rear, left, and right sides.

The heat exchanger tube block 100 constitutes part of an exhaust heat recovery boiler 101 configured to recover heat from exhaust gas. The heat exchanger tube block 100 is manufactured in a factory different from a construction site of the exhaust heat recovery boiler 101 and is then conveyed to the construction site. Moreover, as shown in FIG. 1, a plurality of heat exchanger tube blocks 100 are stacked on each other in the upper-lower direction and connected to each other. To be specific, the exhaust heat recovery boiler 101 includes a plurality of heat exchanger tube blocks 100 stacked on each other in the upper-lower direction and connected to each other. Moreover, the exhaust heat recovery boiler 101 is constructed by stacking a plurality of heat exchanger tube blocks 100 on each other in the upper-lower direction and connecting the plurality of heat exchanger tube blocks 100 to each other.

The heat exchanger tube block 100 according to the present embodiment includes a duct casing 10, heat exchanger tubes 20, an inlet header 30, outlet headers 40, and a vibration transmitting member 50. The following will describe these components in order.

Duct Casing

The duct casing 10 constitutes part of a duct through which the exhaust gas flows. Upper and lower surfaces of the duct casing 10 are open. The duct casing 10 is formed in a tubular shape having a substantially rectangular section. The exhaust gas flows in the duct casing 10 in the upper-lower direction (downward in the present embodiment). Moreover, the exhaust gas flowing in the duct casing 10 contains a large amount of dust. The exhaust gas of the present embodiment is assumed to be exhaust gas generated in the process of manufacturing cement. However, the exhaust gas is not limited to this.

As shown in FIG. 1, a lower end of the duct casing 10 is formed horizontally, and an upper end of the duct casing 10 is also formed horizontally. A grounding surface which contacts a floor of a cargo bed when conveying the heat exchanger tube block 100 is the lower end of the duct casing 10, and the lower end of the duct casing 10 is formed horizontally. Therefore, the heat exchanger tube block 100 can be stably mounted on the cargo bed without using a special jig or the like. On this account, the conveying work of the heat exchanger tube block 100 can be efficiently performed.

Moreover, the duct casing 10 includes an accommodating portion 11 accommodating the heat exchanger tube 20 and a hollow portion 12 located under the heat exchanger tube 20. Since the duct casing 10 includes the hollow portion 12, an operator can enter into the hollow portion 12 and easily perform maintenance of the heat exchanger tube 20 and the inlet header 30.

Furthermore, the duct casing 10 includes: an upper recess 13 located at an upper-left portion and formed such that an outer surface of the duct casing 10 is concave inward; and a lower recess 14 located at a lower-left portion and formed such that the outer surface of the duct casing 10 is concave inward. The upper recess 13 is formed to be open toward the upper side and the left side (outward in a horizontal direction), and the lower recess 14 is formed to be open toward the lower side and the left side (outward in the horizontal direction). The front and rear sides of the upper recess 13 and the front and rear sides of the lower recess 14 are closed in the present embodiment but may be open.

The lower recess 14 is formed at a position which is located under the vibration transmitting member 50 and corresponds to the hollow portion 12. Specifically, the lower recess 14 is formed at the same height position as the hollow portion 12. Since the heat exchanger tube 20 is not provided at the hollow portion 12, the shapes and sizes of components around the hollow portion 12 can be set relatively freely. Therefore, the lower end of the duct casing 10 can be formed horizontally, and in addition, the lower recess 14 can be easily formed under the vibration transmitting member 50.

Heat Exchanger Tube

The heat exchanger tube 20 is a member configured to transfer heat from the exhaust gas, which flows along an outer surface of the heat exchanger tube 20, to water or steam which flows in the heat exchanger tube 20. The heat exchanger tube 20 is arranged so as to extend horizontally, and the exhaust gas contains a large amount of dust. Therefore, when the exhaust heat recovery boiler 101 operates, the dust gradually accumulates on the heat exchanger tube 20. When the dust accumulates on the heat exchanger tube 20, a heat exchange rate significantly lowers. Therefore, as described below, in the present embodiment, the dust accumulating on the heat exchanger tube 20 is made to fall periodically by utilizing the vibration transmitting member 50.

Inlet Header

Figure 2:
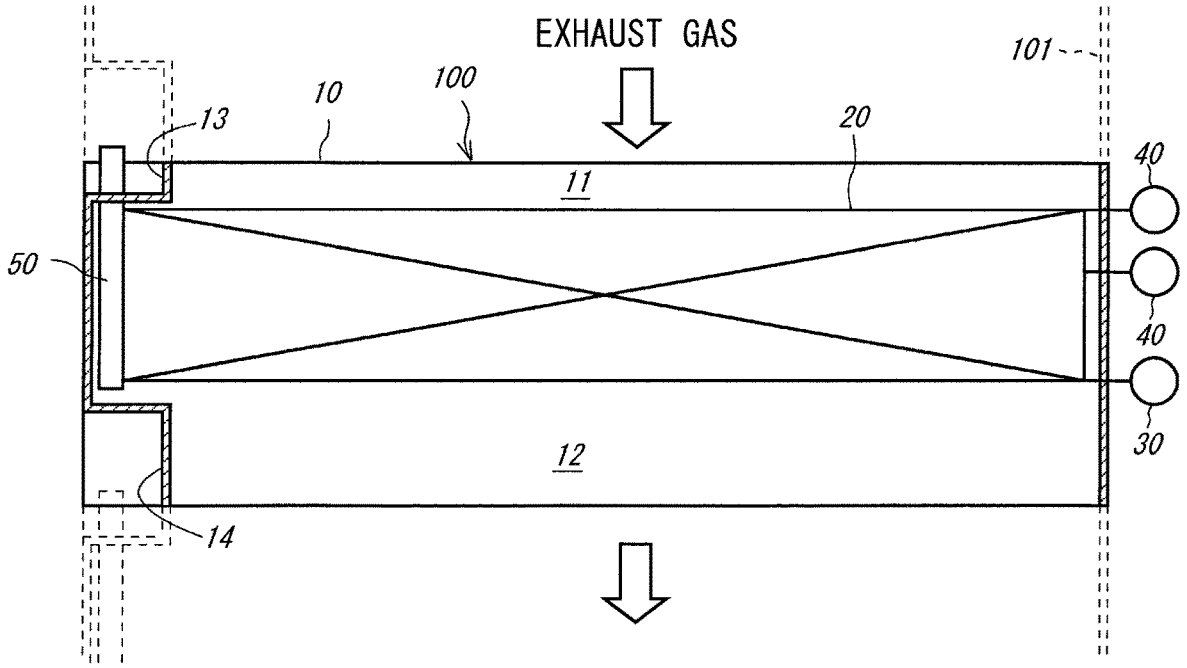
FIG. 2 is a schematic diagram showing a heat exchanger tube block according to Modified Example of Embodiment 1.

The inlet header 30 is a member connected to an inlet of the heat exchanger tube 20. The heat exchanger tube block 100 according to the present embodiment includes one inlet header 30 but may include a plurality of inlet headers 30. The inlet header 30 extends in the front-rear direction and is located lower than the upper end of the duct casing 10 and higher than the lower end of the duct casing 10. More specifically, the inlet header 30 is provided at the hollow portion 12 of the duct casing 10. It should be noted that the inlet header 30 may be arranged outside the duct casing 10. To be specific, the inlet header 30 is arranged at a position corresponding to the hollow portion 12, such as a position inside the hollow portion 12 or a position outside the hollow portion 12. It should be noted that the inlet header 30 may be arranged higher than the hollow portion 12. For example, as shown in FIG. 2, the inlet header 30 may be arranged at the same height position as the heat exchanger tube 20 and outside the duct casing 10.

Water or steam is supplied to the inlet header 30, and the supplied water or steam is distributed to the heat exchanger tubes 20. It should be noted that the water herein may denote hot water or saturated water, and the steam may denote saturated steam or superheated steam. In the present embodiment, by providing the inlet header 30 at the hollow portion 12 of the duct casing 10, the inlet header 30 can be located lower than the heat exchanger tube 20 and higher than the lower end of the duct casing 10. With this, the lower end of the duct casing 10 can be used as the grounding surface when conveying the heat exchanger tube block 100.

Outlet Header

Each of the outlet headers 40 is a member connected to an outlet of the heat exchanger tube 20. The heat exchanger tube block 100 according to the present embodiment includes two outlet headers 40 but may include one outlet header 40 or three or more outlet headers 40. The outlet headers 40 are located outside the duct casing 10 and at the right side of the duct casing 10. Each of the outlet headers 40 recovers the steam from the corresponding heat exchanger tube 20 through an inlet pipe 41 and stores the steam once. Then, the outlet header 40 discharges the steam through a discharge pipe 42 to a facility (not shown).

Moreover, both of the outlet headers 40 are located higher than the lower end of the duct casing 10 and lower than the upper end of the duct casing. Since the outlet headers 40 of the present embodiment are arranged as above, the dimension of the duct casing 10 in the upper-lower direction is equal to the dimension of the heat exchanger tube block 100 in the upper-lower direction. To be specific, according to the present embodiment, the dimension of the heat exchanger tube block 100 in the upper-lower direction can be made smaller than when the outlet headers 40 are located lower than the lower end of the duct casing 10 or higher than the upper end of the duct casing 10. As a result, the conveying work of the heat exchanger tube block 100 can be efficiently performed. It should be noted that in FIG. 1, etc., the outlet headers 40 are located higher than the inlet header 30. However, the outlet headers 40 may be located lower than the inlet header 30.

Vibration Transmitting Member

The vibration transmitting member 50 is a member/body configured to transmit vibration, applied from a vibration generator, to the heat exchanger tube 20 (not shown). The vibration generator may be an apparatus configured to generate vibration by utilizing a so-called striking hammer or an apparatus configured to generate vibration by utilizing ultrasound, a motor, air (soot blower), a piezoelectric element, a shock wave, or the like. The heat exchanger tube 20 is connected to the vibration transmitting member 50. When vibration is transferred to the heat exchanger tube 20, the heat exchanger tube 20 vibrates, and the dust accumulating on the heat exchanger tube 20 falls.

The vibration transmitting member 50 extends upward from an inside of the duct casing 10, and an upper end part of the vibration transmitting member 50 projects to an outside of the duct casing 10. The upper end part of the vibration transmitting member 50 is located at the upper recess 13, and an upper end of the vibration transmitting member 50 is located higher than the upper end of the duct casing 10. It should be noted that the vibration transmitting member 50 may be arranged such that the upper end of the vibration transmitting member 50 is located lower than the upper end of the duct casing 10. Moreover, the vibration transmitting member 50 may be formed integrally from its lower end part to its upper end part or may be formed by separate portions. For example, the vibration transmitting member 50 may be formed by separate portions that are: a portion connected to the heat exchanger tube 20; and a portion including a part projecting to an outside of the duct casing 10. When the vibration transmitting member 50 is formed by separate portions, distortion caused by thermal expansion can be suppressed.

The vibration transmitting member 50 and the vibration generator may interfere with the heat exchanger tube block 100 adjacently located at the upper side. However, according to the heat exchanger tube block 100 of the present embodiment, the duct casing 10 includes the lower recess 14. Therefore, when a plurality of heat exchanger tube blocks 100 are stacked on each other in the upper-lower direction, the vibration transmitting member 50 is located in the lower recess 14 of the heat exchanger tube block 100 adjacently located at the upper side. On this account, according to the heat exchanger tube block 100 of the present embodiment, the vibration transmitting member 50 and the vibration generator can be prevented from interfering with the heat exchanger tube block 100 adjacently located at the upper side.

As above, the heat exchanger tube block 100 according to the present embodiment includes a large number of members, such as the vibration transmitting member 50. Therefore, much work, such as attaching work of the vibration transmitting member 50, at the construction site can be omitted. On this account, the assembly work of the exhaust heat recovery boiler 101 can be efficiently performed. Moreover, according to the heat exchanger tube block 100 of the present embodiment, since the lower end, formed horizontally, of the duct casing 10 serves as the grounding surface which contacts the floor of the cargo bed, the use of the special jig during conveyance can be omitted. As a result, the conveying work of the heat exchanger tube block 100 can be efficiently performed.

Embodiment 2

Figure 3:
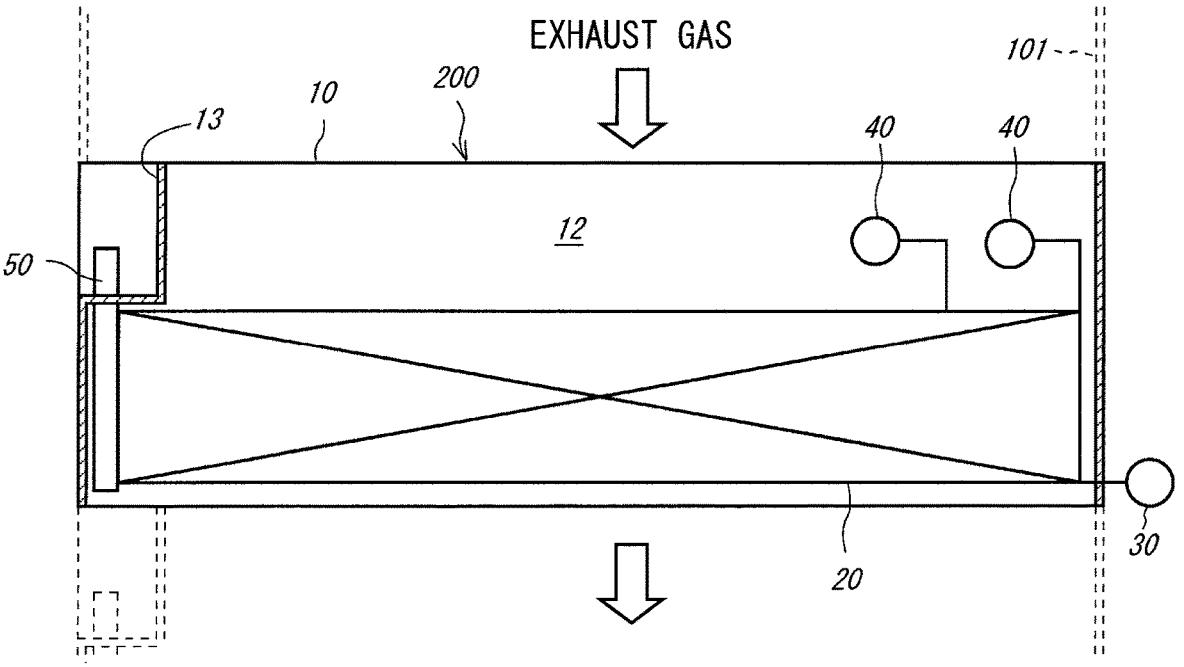
FIG. 3 is a schematic diagram showing a heat exchanger tube block according to Embodiment 2.

Next, a heat exchanger tube block 200 according to Embodiment 2 will be described. FIG. 3 is a schematic diagram showing the heat exchanger tube block 200 according to Embodiment 2. Regarding components of the heat exchanger tube block 200 according to Embodiment 2, the same reference signs are used in FIG. 3 for the same or corresponding components as in Embodiment 1, and the repetition of the same explanation is avoided.

As shown in FIG. 3, the upper recess 13 of the heat exchanger tube block 200 according to the present embodiment is formed larger than the upper recess 13 of the heat exchanger tube block 100 according to Embodiment 1. The upper end part of the vibration transmitting member 50 is located in a region defined by the upper recess 13. Therefore, the vibration transmitting member 50 is located lower than the upper end of the duct casing 10. It should be noted that the duct casing 10 of the present embodiment does not include the lower recess 14 but may include the lower recess 14.

Figure 4:
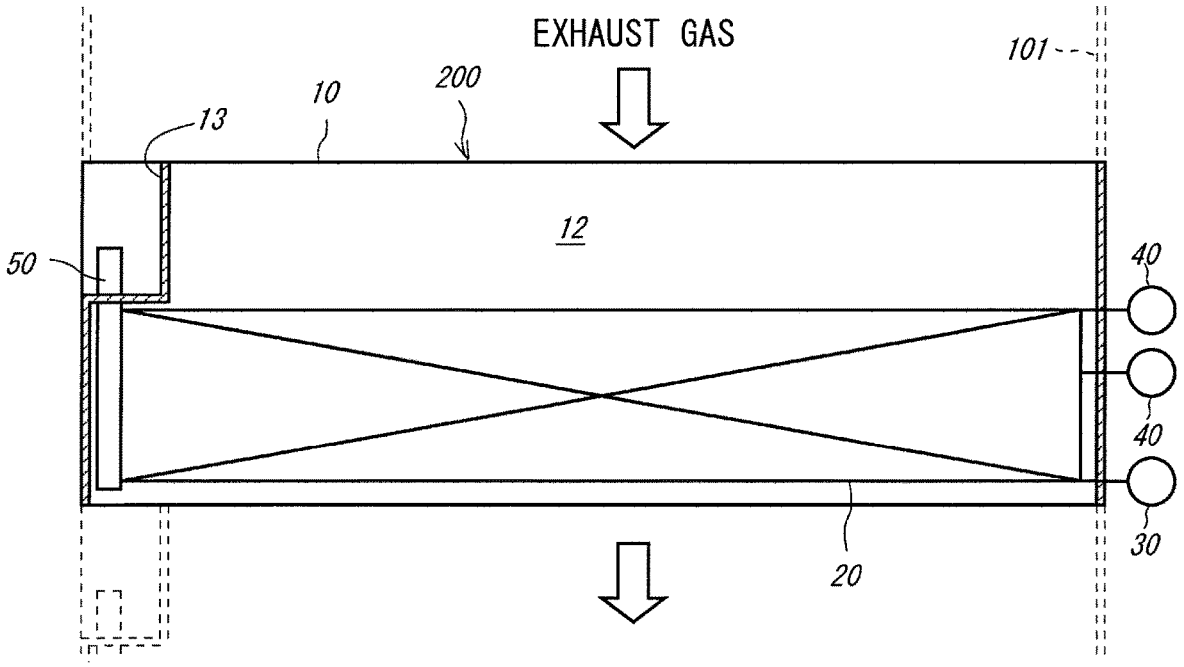
FIG. 4 is a schematic diagram showing a heat exchanger tube block according to Modified Example of Embodiment 2.

Moreover, according to the duct casing 10 of the present embodiment, the hollow portion 12 is located above the heat exchanger tube 20, and the upper recess 13 is formed at the position corresponding to the hollow portion 12. Moreover, the inlet header 30 is located outside the duct casing 10, whereas the outlet headers 40 are provided at the hollow portion 12. However, as shown in FIG. 4, the outlet headers 40 may be located outside the duct casing 10.

As above, according to the heat exchanger tube block 200 of the present embodiment, the upper end part of the vibration transmitting member 50 is located in the region defined by the upper recess 13. Therefore, when the heat exchanger tube blocks 200 are stacked on each other in the upper-lower direction, the vibration transmitting member 50 and the vibration generator can be prevented from interfering with the heat exchanger tube block 200 adjacently located at the upper side. Moreover, since the lower end of the duct casing 10 of the present embodiment is also formed horizontally as with Embodiment 1, the conveying work of the heat exchanger tube block 200 can be efficiently performed.

REFERENCE SIGNS LIST

10 duct casing
12 hollow portion
13 upper recess
14 lower recess
20 heat exchanger tube
30 inlet header
40 outlet header
50 vibration transmitting member
100 heat exchanger tube block
101 exhaust heat recovery boiler
200 heat exchanger tube block

The invention claimed is:

1. A heat exchanger tube block comprising:
a duct casing in which exhaust gas containing dust flows in an upper-lower direction;
a heat exchanger tube located in the duct casing and extending in a horizontal direction;
an inlet header connected to an inlet of the heat exchanger tube;
an outlet header connected to an outlet of the heat exchanger tube; and
a vibration transmitting body configured to transmit vibration, applied to an upper end part of the vibration transmitting body, to the heat exchanger tube to make the dust accumulating on the heat exchanger tube fall, wherein:
upper and lower surfaces of the duct casing are open;
the duct casing is formed in a tubular shape;
a lower end of the duct casing extends horizontally;
an upper end of the duct casing extends horizontally;
the inlet header is located higher than the lower end of the duct casing;
the outlet header is located higher than the lower end of the duct casing;
the duct casing includes a lower recess formed such that an outer surface of the duct casing is concave inward;
the lower recess is located under the vibration transmitting body and is formed so as to open downward and outward in the horizontal direction;
the duct casing includes an upper recess formed such that an outer surface of the duct casing is concave inward;
the upper recess is formed so as to open upward and outward in the horizontal direction, with an upper end of the upper recess being located at the upper end of the duct casing;
the upper end part of the vibration transmitting body extends above the upper recess; and
the inlet header is located at a hollow portion of the duct casing below the heat exchanger tube between the upper and lower recesses and the outlet header.

2. The heat exchanger tube block according to claim 1, wherein the upper end part of the vibration transmitting body projects to an outside of the duct casing.

3. The heat exchanger tube block according to claim 1, wherein:
the outlet header is located lower than the upper end of the duct casing.

4. An exhaust heat recovery boiler comprising a plurality of heat exchanger tube blocks each of which is the heat exchanger tube block according to claim 1, wherein
the plurality of heat exchanger tube blocks are stacked on each other in the upper-lower direction and connected to each other.

5. A method of manufacturing an exhaust heat recovery boiler,
the method comprising
stacking a plurality of heat exchanger tube blocks, each of which is the heat exchanger tube block according to claim 1, on each other in the upper-lower direction and connecting the plurality of heat exchanger tube blocks to each other.

* * * * *